United States Patent [19]

Oka et al.

[11] 3,996,072

[45] Dec. 7, 1976

[54] PHOSPHATE COATING PROCESS AND CONTROL OF THE PHOSPHATE COATING SOLUTION

[75] Inventors: Shoji Oka, Nara; Ryoichi Murakami, Neyagawa; Toshihiro Okai, Amagasaki, all of Japan

[73] Assignee: Nippon Paint Co., Ltd., Osaka, Japan

[22] Filed: Aug. 21, 1975

[21] Appl. No.: 606,609

[30] Foreign Application Priority Data

Aug. 23, 1974 Japan ..... 49-97251

[52] U.S. Cl. ..... 148/6.15 R; 148/6.15 Z; 148/6.16; 427/345; 210/30 R; 210/34; 210/37 R

[51] Int. Cl.[2] ..... C23F 7/08

[58] Field of Search ..... 148/6.15 Z, 6.15 R, 148/6.16; 427/345; 210/30, 37, 34

[56] References Cited

UNITED STATES PATENTS

| | | | |
|---|---|---|---|
| 2,909,455 | 10/1959 | Newhard Jr. et al. | 148/6.16 |
| 2,967,791 | 1/1961 | Halversen | 148/6.16 |
| 3,015,594 | 1/1962 | Russell | 148/6.15 Z |
| 3,455,816 | 7/1969 | Swanson | 210/30 |
| 3,516,875 | 6/1970 | Rausch et al. | 148/6.15 Z |

*Primary Examiner*—Dennis E. Talbert, Jr.
*Assistant Examiner*—Charles R. Wolfe, Jr.
*Attorney, Agent, or Firm*—Wenderoth, Lind & Ponack

[57] ABSTRACT

A phosphate coating solution for forming coatings on a metal surface is contacted with an anion-exchanger loaded or contacted with nitrite ions, whereby the nitrate ions present in the coating solution are replaced by the nitrite ions. This process permits continued operation of a phosphate coating process without replenishing a nitrite solution. This process also allows no accumulation of alkali metal and/or ammonium ions unavailable for the phosphate coating and provides uniform coatings with satisfactory coating properties on the metal surface.

16 Claims, 2 Drawing Figures

PHOSPHATE COATING PROCESS AND CONTROL OF THE PHOSPHATE COATING SOLUTION

Figure 1:
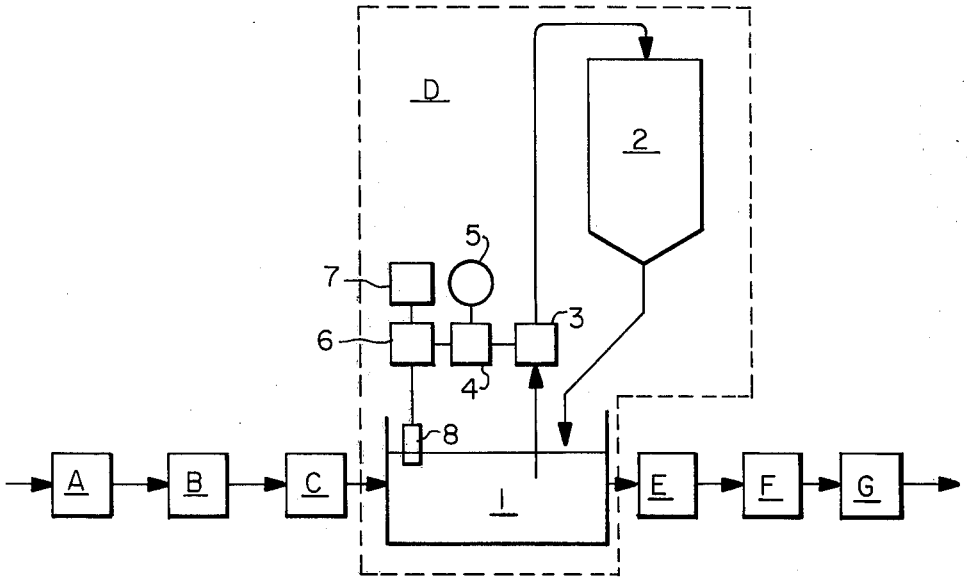

The present invention relates to an improved method for forming phosphate coatings on metallic surfaces. More particularly, it relates to a method of forming phosphate coatings thereon with good properties in which the phosphate containing solution is controlled in the operation of the phosphate coating process by bringing a portion of such a coating solution into contact with an anion-exchanger loaded or contacted with nitrite ions and consequently replacing thereby the nitrate ions present in the solution. Furthermore, the present invention relates particularly to a method of controlling the phosphate coating solution so as to contain alkali metal ions and/or ammonium ions in an appropriate concentration.

In the operation of processes for forming phosphate coatings on metallic surfaces, it is well known that a continuous operation requires replenishment of the metallic ions which form the coating as well as the other ingredients of the coating bath in order to compensate for the loss of the ingredients in the coating solution bath which are consumed in the process of forming the coating on the metal surfaces or which are drained off as residuary solution as the coated metallic substrate is transferred to subsequent water rinse stations. This replenishment is also needed for concurrently maintaining the acid ratio, total acidity and the concentrations of the necessary ions in the coating solution at an appropriate level.

Alkali metal nitrites or ammonium nitrite are also replenished usually as accelerating agents, as necessary, in controlling the concentration of nitrite ion in the coating solution at a substantially constant level, i.e. in substantially the initial concentrations which were present in the coating bath as formulated. This, however, may permit accumulation of alkali metal ions and/or ammonium ions which are unavailable for forming phosphate coatings and concurrently raise a pH value of the bath, thereby causing the precipitation of zinc phosphate according to the following reaction scheme:

$$3Zn(H_2PO_4)_2 \rightleftarrows 4H_3PO_4 + Zn_3(PO_4)_2$$

Thus, the precipitation of zinc phosphate gives rise to a decrease in the zinc ion in the coating bath. The nitrite ions which are added to the phosphate coating system as the accelerator are converted into nitrate ions by oxidation, thereby resulting in the presence in the coating solution to a high concentration and then impairing the phosphate to a high concentration and then impairing the phosphate coating. Accumulation of those ions in the coating solution to an undesirably high concentration leads to the formation of insufficient phosphate coatings on metallic surfaces which may cause poor coating or rusting thereon. In order to avoid these disadvantages, conventional methods employ treating solutions in high concentrations.

The phosphate containing coating solution which is carried away by adhering to the coated metallic surface is drained together with a large amount of water. This drain, however, is a cause of contamination or pollution if it is directly discharged without waste disposal treatment to remove heavy metal ions present in the effluent. This effluent should accordingly be treated prior to discharge and such a waste disposal treatment raises the cost of the phosphate treatment, and the use of a large amount of water may also present the problem from the environmental point of view. In order to obviate these disadvantages, the employment of an apparatus as described and claimed in U.S. patent application Ser. No. 318,612, to Morino et al. now U.S. Pat. No. 3,906,895, in which little or no phosphate coating solution is drained off from the phosphating system is particularly preferred. The problem here, however, is that, since the apparatus is of the type designed to drain off little or no phosphate coating solution out of the phosphate coating process, accumulation of the undesired ions may take place faster than that of said conventional methods. From this, the apparatus of this type, when applied to a phosphate coating process in which conventional phosphate coating solutions are used, requires the renewal of the phosphate coating solution more occasionally than said conventional methods.

Where a phosphate coating solution which contains a nitrite such as sodium nitrite or ammonium nitrite as the accelerator is used, the following two points should be mainly considered to solve the problems as described hereinabove and to provide a satisfactory phosphate coating on metallic surfaces. First, phosphate coating processes should be carried out in which the accumulation of alkali metal ions such as sodium ions and/or ammonium ions be prevented or removal thereof be made with ease. If the use of nitrous acid is possible, the problem with the accumulation of alkali metal ions may be avoidable. However, nitrous acid cannot be used effectively under conventional conditions because of its instability in chemical properties and difficulty in handling. Secondly, the accumulation of nitrate ions in the bath in an undesirably high concentration should be prevented or the accumulated nitrate ions should be removed with ease.

In order to avoid the disadvantages involved in conventional phosphate coating processes, some attempts have been made; for example, U.S. Pat. No. 3,015,594 discloses the use of highly acidic cation-exchange resins substantially saturated and loaded with the coating metal ions. Since these cation-exchange resins possess a negatively charged matrix and exchangeable positive ions (cation) as is well known to the art, they cannot function to exchange for anions so that the sole employment of cation-exchange resins is unable to decrease nitrate ions accumulated in the bath in high concentrations.

It is therefore an objective of the present invention to provide a method of forming on a metallic surface a phosphate coating with desired coating properties using a phosphate coating solution while being contacted with an anion-exchanger.

Another objective of the present invention is to provide a method of controlling a phosphate coating solution containing nitrite ions as the accelerator in such a manner that alkali metal and/or ammonium ions and nitrate ions are not caused to be accumulated in the coating bath to an extent to which they impair properties of phosphate coatings or that they are capable of being removed easily from the bath.

Figure 2:
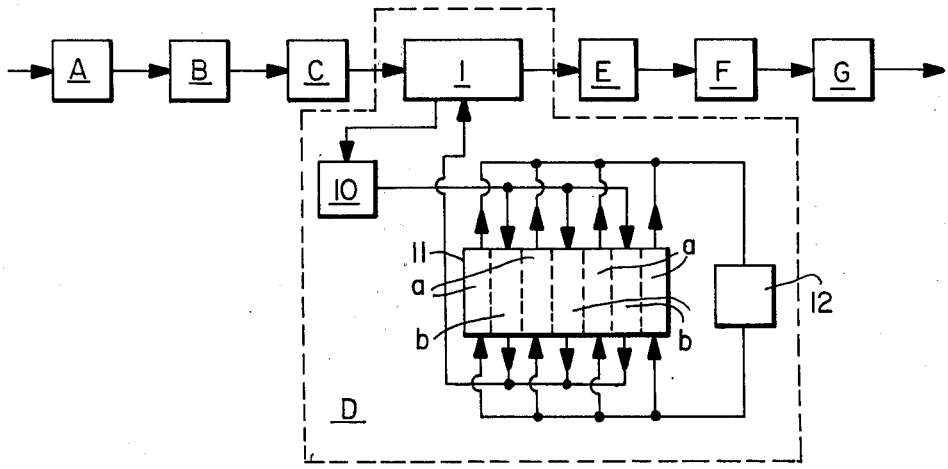

Other objectives, features and advantages of the present invention will become apparent during the course of the following description and the accompanying drawings in which:

FIG. 1 is a schematic diagram showing an embodiment illustrating the method applicable to the present application, in which an ion-exchanging tower is employed; and FIG. 2 is a schematic diagram showing an illustration embodying the present invention in which an ion-exchange membrane is used.

It has been found that said objectives can be achieved by using an anion-exchanger by which nitrate ions in the coating solution which, when accumulated therein in a high concentration, impair the phosphate coatings can be replaced by the nitrite ions during the course of contact thereof with the anion-exchanger. The treatment by the anion-exchanger enables the continuous employment of coating solution without the accumulation of nitrate ions in the bath and can provide satisfactory phosphate coatings on the metallic surfaces.

The anion-exchanger of the present invention may include an anion-exchange resin and an anion-exchange film or membrane. The anion-exchange resin may include a strong base and weak base anion-exchange resin. In the practice of the present invention, anion-exchange resins commercially available may be employed. Examples of said strong base anion-exchange resins are of the type in gel form, such as, for example, "Diaion SA" series (trade mark of Mitsubishi Chemical Industries, Ltd.) and "Amberlite IRA" series (trade mark of Rohm and Haas Co.) and of the type in porous form, such as, for example, "Amberlite 900" or "Amberlite 910", "Diaion PA" series and "Duolite A101D" (trade mark of Chemical Process Co.). The anion-exchange membrane to be used for the present invention may include any membrane which enables to provide nitrite ions and is useful for the purpose of the present invention, for example, "Selemion DMV" (trade mark of Asahi Glass Co., Ltd.) and "Neosepta DFM" (trade mark of Tokuyama Soda Co., Ltd.).

The anion-exchange resin to be used in the practice of the present invention is treated, prior to application, to replace its exchangeable anions by nitrite ions. Where the strong base anion-exchange resins as in chloride form is used, the replacement may be effected by passing a nitrite, such as for example sodium nitrite or ammonium nitrite aqueous solution through an appropriate column which was previously filled with the resin. Where a weak base anion-exchange resin, for example, in hydroxyl form is used, it is initially converted into its salt form and then into the nitrite form because of the difficulty involved in directly converting the weak base resin with a nitrite aqueous solution. Although the velocity at which the solution is passed through the column is not limited to a particular range, it is desirable to effect the passage using a 10 to 15 per cent nitrite aqueous solution in amounts from about two to three times, per unit time, greater than the volume of the resin filled in the column. The resin thus treated is then rinsed fully with water to remove excess nitrites present in free form in the column.

Where the anion-exchange membrance or film is employed, the replacement by nitrite ions prior to application, as applied to the anion-exchange resins, is unnecessary. It is only necessary that the nitrite solution be counterflown against the coating solution through an appropriate device in which the membranes are suitably disposed.

With the anion-exchanger loaded or contacted with nitrite ions, the method of the present invention may be carried out by contact therewith of a phosphate containing coating solution, thereby exchanging the nitrate ions present in the phosphating solution for the nitrite ions present in the nitrite form anion-exchanger. For example, the velocity at which and the area over which the phosphate coating solution is passed are designed so as to control the nitrite ion concentration in the bath at a desired level. Where the anion-exchanger decreases its capacity to such an extent that it cannot efficiently exchange the nitrate ions for the nitrite ions, the capacity may be recovered by washing the column packed with the anion-exchange resin with water and treating it with fresh nitrite aqueous solution. Where the anion-exchange membrane deteriorates in its capacity for anion-exchange to such an extent that it can no longer provide the nitrite ions effectively, the nitrite solution may be renewed or replenished by fresh nitrite solution to recover its anion-exchanging capacity.

Phosphate containing coating solution which are conventionally used for phosphating purposes may be employed in the present invention. These solutions generally contain a variety of ions, such as chloride, fluoride, borohydrofluoride, silicohydrofluoride, titanium hydrofluoride, tartarate, citrate, lactate, glycerophosphate, acid pyrophosphate, acid orthophosphate and nitrite ions, and metal ions such as zinc, nickel, manganese, iron and calcium. Although these conventional solutions are applicable to the present invention, preferable coating solutions to be used for this purpose possess a pH value of from about 1.0 to about 3.8. The acidic phosphate coating solutions which are applicable to the process of the present invention may include acidic zinc phosphate coating solution, acidic zinc calcium phosphate coating solution and acidic zinc manganese phosphate coating solution. The acidic zinc phosphate coating solution may have the following composition (by weight): zinc ion, from about 0.05 to 0.5 percent; nickel ion, from 0 to about 0.2 percent; sodium ion, from 0 to about 0.5 percent; phosphate ion, from about 0.2 to 2.0 percent; nitrate ion, from about 0.1 to 2.0 percent; and nitrite ion, from about 0.005 to 0.5 percent. The acidic zinc calcium phosphate coating solution may contain calcium ions in an amount of from about 0.01 to 2.0 percent by weight in addition to said composition of the zinc phosphate coating solution. The acidic zinc manganese phosphate coating solution may contain manganese ions in an amount of from about 0.01 to 0.5 percent as well as the composition of said zinc phosphate coating solution.

The method of the present invention can control the phosphate containing coating solution by replenishing the nitrite ions themselves without yet replenishing a nitrite as the accelerating material, thereby disallowing alkali metal ions and/or ammonium ions to accumulate in the bath and concurrently decreasing the amounts of salts of phosphate and the ions unavailable for the zinc phosphate coating. Furthermore, the present invention can avoid a decrease in zinc ions due to the accumulation of the alkali metal ions and/or ammonium ions in the coating bath. The present invention can also decrease an excessive amount of phosphate ions which are consumed for the neutralization of alkali metal and/or ammonium ions so that the phosphate coating also becomes feasible in the total acid pointage of the solution ranging from about 2.5 to 7 points (as determined by the number of millimeters of 0.1 sodium hydroxide solution required to neutralize 10 milliliters of the coating solution to a phenolphthalein end point); the phosphate coating according to the present invention can be effected far below the range, viz., from 8 to 50 points, in which conventional methods are possible. The method of the present invention can also be carried out at lower temperatures and for shorter periods of time than conventional methods can.

In the practice of the present invention, the method may be applicable to a multiple station system apparatus of the type which is designed to modify multiple station apparatus as conventionally employed for phosphate coating processes. The apparatus which is applicable to the method of the present invention is a six-station or seven-station treating arrangement. For example, a six-station apparatus is arranged in which the first station is a cleaning or degreasing station; the second is a first water rinse station; the third is a second water rinse station; the fourth station corresponds to a phosphate coating solution; the fifth is a third water rinse station; and the sixth station corresponds to a fourth water rinse station; said phosphate coating station being provided with an ion-exchanging device through which the phosphate coating solution to be treated is passed so as to control the nitrite ion concentration at an appropriate level. In the seven-station apparatus, an acidulating station or another water rinse station may be disposed adjacent to the last water rinse station which is provided for the six-station apparatus. The phosphate coated workpieces or sheet stock passing from the last rinse station may then be dried conventionally so as to remove the residual liquid from the coated metal surfaces for further processing such as painting. Variations in the number of stations employed for effecting the phosphate coating can be made, for example, by the omission of one of the rinse stations or the addition thereto of another rinse station. An apparatus which is described in U.S. patent application Ser. No. 318,612 now U.S. Pat. No. 3,906,895, to Morino et al. may be applicable preferably to the method of the present invention. The apparatus described in this patent application is a spray type apparatus having a spray chamber for treatment of a metal surface with a coating solution, followed by rinsing the metal surface with water, in which little or no phosphate coating solution is discharged out of the system. In the application of this apparatus to the method of the present invention, a station for effecting the ion-exchanging of a coating solution is connected to the phosphating station. Thus, the apparatus applicable to the method of the present invention is a multiple station system containing a phosphate coating station to which, for example, an ion-exchanging tower is connected or to which, for example, an ion-exchanging dialyser with an anion-exchange membrane is connected.

The system of ion-exchanging the phosphate coating solution according to the present invention is provided preferably with means, whereby said solution is passed through a device in which the anion-exchanger is disposed. Referring first in detail to FIG. 1 of the drawings, a processing arrangement of the type which is preferably applicable to the method of the present invention is typical of a seven-station processing apparatus, in which there are consecutively provided a degreasing station at A; a first water rinse station at B; a second water rinse station at C; a phosphate coating station at D; a third water rinse station at E; a fourth water rinse station at F; and an acidulating station at G. A phosphate coating bath 1 comprising phosphating station D is connected to an ion-exchanger 2 such that the coating solution to be treated is circulated through the ion-exchanger. The ion-exchanger 2 may be of the fixed bed type or of any other type applicable to the ion-exchanging of phosphate coating. In a pipe (not shown) extending from the bath or tank 1 to the ion-exchanger 2 is a pump 3 which can pump solution up to the ion-exchanger 2 through which the nitrate ions present in the solution are replaced by the nitrite ions present as exchangeable anions in an anion-exchange resin packed or filled in the ion-exchanger 2. The pump 3 is connected through a control 4 to a motor 5 rotating at a constant rotation and designed so as to operate in response to a signal transmitted by said control which is comprised of a magnetic joint such as, for example, a joint, coupling or clutch, and an electromagnetic coil disposed therein. The magnetic joint is designed such that the torque of the motor 5 is transmitted to a shaft connected to the pump 3 in response to the magnetic induction produced by electromagnetic force into which an electric current is transformed by means of a magnetic coil disposed in a computing device 6 for computing the difference in signals and transmitting a signal to the control 4. In effecting the pumping by means of the pump 3, it is also possible to use a system in which said pump is connected by a shaft without a joint means to the motor 5 such that the rotation of said motor is controlled by the control 4 in response to the signal transmitted by the computing device 6.

The computing device 6 is comprised of a reference signal generator 7 for generating a reference signal and a measuring instrument 8 for determining the concentration of nitrite ion in the phosphate coating solution as the oxidation-reduction potential. Said computing device is designed so as to transmit an electrical signal to the control 4 in response to the difference in signals given by the reference signal generator 7 and the measuring instrument 8. The signals transmitted by both the reference signal generator 7 and the measuring instrument 8 are computed as the difference between the two signals and then transformed into an electric current varying continuously from about 10 to 50 millivolts by means of the computing device. This electric current is then applied to the control 4 which can in turn control the rotation of the motor 5 in response to the given electric current signals.

The reference signal generator 7 may include a direct current potentiometer circuit or a rheostat circuit for setting the reference signal. Said reference signal generator 7 is designed so as to apply the oxidation-reduction potential of the phosphate coating solution in response to a range in the predetermined concentration of nitrite ion within which a good and uniform coating is provided.

The measuring instrument 8 for determining the nitrite ion concentration in the phosphate coating solution as the oxidation-reduction potential may include any instrument which can be employed to measure, directly or indirectly, the nitrite ion concentration in the phosphate coating solution. A measuring instrument to be used for this purpose may be composed of a pair of electrodes comprising a platinum rod or a platinum plate electrode and a calomel reference electrode which are placed in the solution. This instrument is capable of measuring the oxidation-reduction potential arising from the oxidation of the ferrous ions originating from the ferrous metal object with the nitrite ions into the ferric ions. This instrument and the mode of determination of the oxidation-reduction potential are disclosed, for example, in U.S. patent application Ser. No. 390,375 now U.S. Pat. No. 3,922,669 (Japanese patent publication No. 10,051/1967). An alternative instrument for determining the nitrite ion concentration is an instrument which can be used to measure the oxidation-reduction potential by continuously passing samplings of the phosphate coating solution through a cell with a pair of electrodes comprising a platinum electrode and a calomel reference electrode, the samplings having previously been mixed with a predetermined amount of a cerium salt solution. An automatic titration instrument may also be used for this purpose, wherein samplings of the coating solution which were collected periodically and to which a few drops of dilute sulfuric acid were previously added are titrated with potassium permanganate and the titration end point is determined as the oxidation-reduction potential.

In the practice of the present invention, it is desired that the anion-exchanger is treated for recovery of its anion-exchanging capacity before it can no longer function effectively. For example, where the anion-exchange resin is used, the circulation of equal amounts per unit time of the coating solution through the ion-exchange tower cannot compensate for the amount of nitrite ions consumed when the ion-exchangeability of the anion-exchanger decreases. To avoid the problems arising from this phenomenon, the system applicable to the present invention is designed so as to be capable of supplying the coating solution in amounts corresponding to the amounts that contain the nitrite ions needed for compensating for the nitrite ions consumed. Thus, for example, if the ion-exchangeability of the anion-exchanger goes down to 50 percent compared to the initial value, the amount of the coating solution to be supplied to the anion-exchanger is allowed to flow therethrough by two times, thereby controlling the nitrite ions to the initial concentration. That is, a decrease in the replenishment of the nitrite ions due to deterioration in the ion-exchangeability of the anion-exchanger is compensated for an increase in the amounts of the solution contacted with the anion-exchanger.

Referring now to FIG. 2 of the drawings, a processing arrangement illustrated therein is of a type similar to that illustrated in FIG. 1 except for the provision in phosphating station D of a device in which an ion-exchange membrane is employed in place of the ion-exchange resin. This device is composed of a filter 10, an ion dialyser 11, and a nitrite solution tank 12. In this process arrangement, the phosphate coating solution to be treated is supplied from the phosphating tank 1 through the filter 10 to the ion dialyser 11 in which it is divided into a plurality of compartments by anion-exchange membrane partitions which can serve as the supplier of nitrite ions therethrough to the coating solution. The compartments are employed for two different purposes; one is for the passage of the coating solution, indicated by letter *a*, and the other for recycling the nitrite solution, indicated by letter *b*. Although numbers of the two different purpose compartments may be the same, it is preferred that the number of the compartments for the flow of recycle nitrite solution exceeds that of the coating solution compartments by one, and the recycle nitrite solution compartments are disposed at the both outermost sides of the ion dialyser 11 and, in the middle therebetween, the phosphating solution compartments and the nitrite solution recycling compartments are juxtaposed alternatively, i.e. so as to allow the phosphating solution compartment to come adjacent the nitrite solution recycling compartment and then allow the latter to come adjacent the other phosphating solution compartment, and this arrangement is repeated until the dialyzer is provided with predetermined sheets of the anion-exchange membranes depending upon the desired area over which the phosphate coating solution is contacted. The solution containing an undesirable concentration of nitrate ion is treated so as to contain a desired concentration of nitrite ion during the passage of a solution through the compartments for coating solution and then circulated back to the tank for further phosphate coating. The recycled nitrite solution is also recycled back to the recycled nitrite solution tank 12 and then supplied to the ion dialyser 11 until it loses the capacity of effectively furnishing nitrite ions. When the recycled nitrite solution contains an undesirable amount of nitrate ions and can no longer furnish nitrite ions effectively, then such a solution is replaced or replenished by fresh nitrite solution.

The apparatus as illustrated in FIG. 2 also provides a system for automatically controlling the nitrite ion concentration of the phosphate coating solution, as with the apparatus illustrated in FIG. 1. The system as used for the apparatus illustrated in FIG. 1 may be connected at its entrance side to the filter 10, thereby being capable of controlling the nitrite ion concentration of the coating solution and adjusting the supply of a necessary amount thereof to the ion dialyzer 11 so as to exchange the nitrate ions therein for the nitrite ions from the recycle solution.

The following Examples serve to illustrate the present invention without, however, limiting the same thereto.

EXAMPLE 1

An apparatus as described in FIG. 1 and also in U.S. patent application Ser. No. 318,612 to Morino et al. was employed herein. This apparatus is designed such that fresh makeup water is supplied to the fifth water rinse station at G so as to allow the overflow of rinse water therefrom to be transferred to the fourth water rinse station, then the overflow of water rinse from said fourth station to the third one, and the overflow from the third one to the phosphate coating station. The amount of the water rinse overflowing from the third water rinse station, corresponding in amount to the amount of fresh makeup water supplied, is evaporated and discharged from the coating bath having a capacity of 300 liters at the phosphating station.

An anion-exchange resin used for the ion-exchange station was prepared by passing 15 liters of a 10 percent sodium nitrite aqueous solution at room temperature through a 5-liter column filled with a strong base anion-exchange resin ("Diaion SA10A", trade mark of Mitsubishi Chemical Industries, Ltd.) and washing the column thoroughly with water, whereby said anion-exchange resin is loaded and saturated by nitrite ions.

A phosphate containing coating solution used herein had the initial concentrations of the ions as indicated in Table 1 which follows. This coating solution had a total acidity of 15; a free acidity of 0.6; an acid ratio of 25; and a pH of 3.0.

With the apparatus and phosphate coating solution as described hereinabove, a ferrous metal sheet was treated in conventional manner at a rate of 30 square meters per hour at a temperature of 50° to 55° C. In this case, the ion-exchange station is designed so as to have the coating solution pass therethrough to maintain the nitrite ion concentration of 0.0077 percent. It was found that the nitrite ion was consumed at a rate of 0.33 mole per hour.

In this procedure, the replenishment was made using a phosphate coating aqueous solution having the composition and the following content per liter of the treating solution: 2.4 moles of zinc ion; 5.8 moles of phosphate ion; 0.25 mole of nickel ion; and 1.0 mole of nitrate ion. This solution was replenished at a rate of 0.188 liter per hour.

COMPARATIVE EXAMPLE 1

With the same apparatus employed in Example 1 which, however, does not include the ion-exchanging device, the procedure of Example 1 was repeated using the same procedure and coating solution used in Example 1 except for the replenishment of a 20 percent sodium nitrite aqueous solution in place of the employment of the ion-exchange resin packed column as conventionally applied. The sodium nitrite solution was replenished to compensate for the nitrite ions consumed and at the same time maintain the nitrite ion therein in the concentration of about 0.0077 percent.

Table 1 presents the initial concentrations of the ions in the coating solution as well as variations in their concentrations after being used for phosphating for both 100 and 300 hours. In this table, the results are also set out with respect to appearance on coatings applied to the surfaces of the ferrous metals which had previously been phosphate-coated. The same thing can be applied to the other tables which follow.

TABLE 1

| | Ion Concentrations (per cent) | | | | |
|---|---|---|---|---|---|
| | Initial | EXAMPLE 1 | | COMPARATIVE EX. 1 | |
| Ions | conc. | 100 hrs. | 300 hrs. | 100 hrs. | 300 hrs. |
| $Zn^{2+}$ | 0.080 | 0.074 | 0.075 | 0.061 | 0.035 |
| $Na^{+}$ | 0.30 | 0.30 | 0.30 | 0.49 | 0.77 |
| $Ni^{2+}$ | 0.020 | 0.020 | 0.020 | 0.020 | 0.020 |
| $PO_4^{3-}$ | 1.0 | 1.0 | 1.0 | 1.0 | 1.0 |
| $NO_3^{-}$ | 0.50 | 0.49 | 0.46 | 0.83 | 1.48 |
| $NO_2^{-}$ | 0.0077 | 0.0077 | 0.0077 | 0.0077 | 0.0077 |

Conditions of Phosphate Coatings on Ferrous Metal Surfaces

| | | | | |
|---|---|---|---|---|
| Good, uniform & fine coating | Good, uniform & fine coating | Good, uniform & fine coating | Good, uniform & fine coating | Poor & coarse coating with rust |

Table 1 above indicates that the present invention as represented by Example 1 neither increases the sodium and nitrate ions nor brings about a decrease in the zinc ion concentration to a significant extent even when being treated for 300 hours. On the other hand, the conventional method as represented by Comparative Example 1 in which sodium nitrite aqueous solution is used as the replenishing agent causes the accumulation of those ions and decreases the concentration of zinc ions in both 100 and 300 hours. It is also shown that Example 1 can provide a good coating even in 300 hours.

EXAMPLE 2

With the apparatus and procedures used in Example 1, a ferrous metal sheet was sprayed for 2 minutes at a temperature of 50° to 55° C. but using a phosphate coating solution having the initial ion concentrations as indicated in Table 2 below. This solution had a total acidity of 5.6, an acid ratio of 14, and a pH of 3.0

COMPARATIVE EXAMPLE 2

The procedure of Comparative Example 1 was repeated using the same coating solution in the same manner as used in Example 2.

TABLE 2

| | Ion Concentrations (per cent) | | | | |
|---|---|---|---|---|---|
| | Initial | EXAMPLE 2 | | COMPARATIVE EX. 2 | |
| Ions | conc. | 100 hrs. | 300 hrs. | 100 hrs. | 300 hrs. |
| $Zn^{2+}$ | 0.15 | 0.14 | 0.15 | 0.10 | 0.04 |
| $Na^{+}$ | 0.02 | 0.02 | 0.019 | 0.16 | 0.42 |
| $PO_4^{3-}$ | 0.30 | 0.30 | 0.30 | 0.30 | 0.29 |
| $NO_3^{-}$ | 0.15 | 0.16 | 0.15 | 0.48 | 1.13 |
| $NO_2^{-}$ | 0.01 | 0.01 | 0.01 | 0.01 | 0.01 |
| $Ni^{2+}$ | 0.020 | 0.020 | 0.020 | 0.020 | 0.020 |

Conditions of Phosphate Coatings on Ferrous Metal Surfaces

| | | | | |
|---|---|---|---|---|
| Good, uniform & fine coating | Good, uniform & fine coating | Good, uniform & fine coating | Not very good & coarse coating | Poor & coarse coating with rust |

Table 2 indicates that the concentrations of nitrate and sodium ions in the phosphate coating solution treated according to the method of the present invention as represented by Example 2 do not vary even after a 300-hour treatment, thereby causing no decrease in the zinc ion concentration. On the other hand, the conventional method as conducted by Comparative Example 2 raises the concentrations of the sodium and nitrate ions to a greater extent even in 100 hours than the method of the present invention, and a decrease in the zinc ion concentration is also remarkable in both 100 and 300 hours for the conventional method.

It is also noted that, in order to form good coatings on the metal object, it is necessary for the coating solution to possess higher total acidity, i.e. from 12 to 15 points for the conventional method than that of the present invention in which the total acid pointage was 5.6.

EXAMPLE 3

With the apparatus of Example 1, the procedure of Example 1 was repeated by treating a ferrous metal sheet at a temperature of 35° to 40° C. using a phosphate coating solution having the initial concentration of ions as indicated in Table 3 which follows. The phosphate coating solution had a total acidity of 15, an acid ratio of 20 and a pH of 3.2.

COMPARATIVE EXAMPLE 3

With the apparatus of Comparative Example 1, the procedure of Example 3 was repeated using the same coating solution employed therein.

TABLE 3

| | Ion Concentrations (per cent) | | | | |
|---|---|---|---|---|---|
| | Initial | EXAMPLE 3 | | COMPARATIVE EX. 3 | |
| Ions | conc. | 100 hrs. | 300 hrs. | 100 hrs. | 300 hrs. |
| $Zn^{2+}$ | 0.37 | 0.37 | 0.38 | 0.28 | 0.15 |
| $Na^{+}$ | 0.05 | 0.05 | 0.04 | 0.19 | 0.46 |
| $Ni^{2+}$ | 0.10 | 0.10 | 0.10 | 0.10 | 0.10 |
| $PO_4^{3-}$ | 0.80 | 0.80 | 0.80 | 0.80 | 0.79 |
| $NO_3^{-}$ | 0.50 | 0.50 | 0.50 | 0.83 | 1.48 |
| $NO_2^{-}$ | 0.01 | 0.01 | 0.01 | 0.01 | 0.01 |

TABLE 3-continued

| Ions | Initial conc. | EXAMPLE 3 100 hrs. | EXAMPLE 3 300 hrs. | COMPARATIVE EX. 3 100 hrs. | COMPARATIVE EX. 3 300 hrs. |
|---|---|---|---|---|---|
| | Ion Concentrations (per cent) | | | | |
| Conditions of Phosphate Coatings on Ferrous Metal Surfaces | | | | | |
| | Good, uniform & fine coating | Good, uniform & fine coating | Good, uniform & fine coating | Not very good & coarse coating | Poor & coarse coating with rust |

Table 3 shows substantially the same tendency as indicated by the two previous test results as seen in Tables 1 and 2. In this table, too, almost no variations in the concentrations of the sodium, nitrate, and zinc ions are recognize for the present invention, whereas the conventional method shows considerable undesirable changes in those ions. There is also a significant difference in appearance between the coatings applied to the surfaces of the treated metal surfaces.

It is also to be understood that, in order to obtain a phosphate coating as good as that of the present invention, the phosphate coating according to the conventional method should be effected at higher temperature, namely from about 50° to 60° C., than that of the present invention.

EXAMPLE 4

With the apparatus of Example 1, the procedure of Example 1 was repeated in which a ferrous metal sheet was sprayed for 30 seconds with the coating solution employed in Example 3 at a temperature of 50° to 55° C.

COMPARATIVE EXAMPLE 4

With the apparatus of Comparative Example 1, the procedure of Example 4 was repeated using the coating solution employed therein to give a phosphate coating on the ferrous metal surfaces.

TABLE 4

| Ions | Initial conc. | EXAMPLE 4 100 hrs. | EXAMPLE 4 300 hrs. | COMPARATIVE EX. 4 100 hrs. | COMPARATIVE EX. 4 300 hrs. |
|---|---|---|---|---|---|
| | Ion Concentrations (per cent) | | | | |
| $Zn^{2+}$ | 0.37 | 0.38 | 0.38 | 0.25 | 0.112 |
| $Na^{+}$ | 0.05 | 0.04 | 0.04 | 0.21 | 0.53 |
| $Ni^{2+}$ | 0.10 | 0.11 | 0.10 | 0.09 | 0.10 |
| $PO_4^{3-}$ | 0.80 | 0.80 | 0.79 | 0.79 | 0.80 |
| $NO_3^{-}$ | 0.50 | 0.52 | 0.52 | 0.85 | 1.60 |
| $NO_2^{-}$ | 0.01 | 0.01 | 0.01 | 0.01 | 0.01 |
| Conditions of Phosphate Coatings on Ferrous Metal Surfaces | | | | | |
| | Good, uniform & fine coating | Good, uniform & fine coating | Good, uniform & fine coating | Good, uniform & fine coating | Poor & coarse coating with rust |

Table 4 also indicates that substantially the same tendency as shown in the previous test results presented in Tables 1 through 3 was also recognized, particularly in 300 hours.

It is also to be noted that, in order to obtain as good coatings as those obtained according to the present invention, the conventional method should be carried out for a longer period of time, viz., from 1.5 to 2 minutes, than the present invention by which the substantially the same results can be obtained in 30 seconds.

EXAMPLE 5

With an apparatus as disclosed in FIG. 2, an ion dialysis device was provided with 100 sheets of anion-exchange membranes ("Neosepta DMF", trade mark of Tokuyama Soda Co., Ltd.; film area, 100 square centimeters per sheet) which were juxtaposed in a distance of 2 millimeters between each other. This ion dialysis device was connected to the phosphate coating station through a filter. This device was also equipped with a nitrite solution container by means of which the solution is passed through the dialysis device so as to thereby maintain a capacity of the film for providing nitrite ions. The recycle nitrite solution in said container was allowed to flow upwardly through the dialyser compartments, and the solution to be treated was caused to pass downwardly therethrough. The recycle solution used was a 20 percent sodium nitrite aqueous solution, and the solution was adjusted to contain a nitrite ion concentration of 0.01 percent while it was passed through the dialyser compartments.

The phosphate coating solution as employed in Example 2 was used herein.

Table 5 below presents the concentrations of the ions in both 100 and 300 hours and the appearances of coatings on the metal surfaces treated for these said periods of time. For the brevity of comparison, the results obtained with Comparative Example 2 were set out again in Table 5 which follows.

TABLE 5

| Ions | Initial conc. | EXAMPLE 5 100 hrs. | EXAMPLE 5 300 hrs. | COMPARATIVE EX. 2 100 hrs. | COMPARATIVE EX. 2 300 hrs. |
|---|---|---|---|---|---|
| | Ion Concentrations (per cent) | | | | |
| $Zn^{2+}$ | 0.15 | 0.15 | 0.14 | 0.10 | 0.04 |
| $Na^{+}$ | 0.02 | 0.03 | 0.05 | 0.16 | 0.42 |
| $PO_4^{3-}$ | 0.30 | 0.30 | 0.30 | 0.30 | 0.29 |
| $NO_3^{-}$ | 0.15 | 0.16 | 0.17 | 0.48 | 1.13 |
| $NO_2^{-}$ | 0.01 | 0.01 | 0.01 | 0.01 | 0.01 |
| $Ni^{2+}$ | 0.020 | 0.020 | 0.020 | 0.020 | 0.020 |
| Conditions of Phosphate Coatings on Ferrous Metal Surfaces | | | | | |
| | Good, uniform & fine coating | Good, uniform & fine coating | Good, uniform & fine coating | Not very good & coarse coating | Poor & coarse coating with rust |

Table 5 indicates that the use of the anion-exchange membrane can give almost the same results as obtained when the ion-exchange resin was used. In Example 5, no variatons in the concentrations of the sodium, nitrate and zinc ions are recognized even in 300 hours, whereas the conventional method, as represented again by Comparative Example 2, goes contrary because those ions are caused to vary to an undesirably great extent even in 100 hours. The employment of the ion-exchange membrane also provided good coatings when applied to the metal surfaces thus treated.

What we claim is:

1. A method of forming phosphate coatings on the surfaces of a metal object which comprises applying a phosphate coating solution containing a nitrite to the metal surfaces, said coating solution being contacted with an anion-exchanger loaded or contacted with nitrite ions, thereby permitting the substitution of the nitrite ions present in the anion-exchanger for the nitrate ions present in the coating solution during contact with the anion-exchanger in response to variations in the nitrite ion concentration of the coating solution.

2. The method of claim 1, wherein the phosphate coating solution is acidic zinc phosphate coating solution.

3. The method of claim 1, wherein the phosphate coating solution is acidic zinc calcium phosphate coating solution.

4. The method of claim 1, wherein the phosphate coating solution is acidic zinc manganese phosphate coating solution.

5. The method of claim 1, wherein the phosphate coating solution has a pH value of from about 1.0 to 3.8.

6. The method of claim 1, wherein the anion-exchanger is an anion-exchange resin loaded with nitrite ions.

7. The method of claim 6, wherein the anion-exchange resin is a strong base or weak base anion-exchange resin.

8. The method of claim 1, wherein the anion-exchanger is an anion-exchange membrane contacted with nitrite ions.

9. The method of claim 1, wherein the phosphate coating solution is maintained as containing alkali metal ions or ammonium ions or mixtures thereof in a concentration below less than 0.1 percent by weight based on the total weight of the coating solution.

10. The method of claim 1, wherein the phosphate coating solution is used in a phosphate coating process comprising spraying said solution against the surface of the metal object at a phospating station and rinsing the previously treated metal surface with water at a water rinse station, the rinse water being transferred to the phosphate coating station and there eliminated in a vaporized form from the phosphate coating process.

11. A method of controlling the concentration of nitrite ions in a phosphate coating solution which comprises contacting the coating solution with an anion-exchanger, thereby permitting the substitution of the nitrite ions present in the anion-exchanger for the nitrate ions present in the coating solution during contact with the anion-exchanger in response to variations in the oxidation-reduction potential of the coating solution.

12. The method of claim 11, wherein the anion-exchanger is an anion-exchange resin loaded with nitrite ions.

13. The method of claim 11, wherein the anion-exchanger is an anion-exchange membrane contacted with nitrite ions.

14. The method of claim 11, wherein the phosphate coating solution is acidic zinc phosphate coating solution.

15. The method of claim 11, wherein the phosphate coating solution is acidic zinc calcium phosphate coating solution.

16. The method of claim 11, wherein the phosphate coating solution is acidic zinc manganese phosphate coating solution.

* * * * *